US012123640B2

(12) United States Patent
Heidenfelder et al.

(10) Patent No.: US 12,123,640 B2
(45) Date of Patent: Oct. 22, 2024

(54) INTERIOR COMPARTMENT WITH A SPECIFIC SHAPE OF A BEARING RIB, AND DOMESTIC REFRIGERATION APPLIANCE

(71) Applicant: BSH Hausgeräte GmbH, Munich (DE)

(72) Inventors: Ingo Heidenfelder, Taufkirchen (DE); Andreas Kessler, Munich (DE); Andreas Korte, Munich (DE); Andreas Lindel, Dischingen-Dunstelkingen (DE); Daniel Naumburger, Giengen (DE); Ulrich Schlander, Nersingen (DE); Ralph Staud, Munich (DE); Thomas Tischer, Haar (DE); Herbert Weibl, Bachhagel (DE); Georg Kapfer, Medlingen (DE)

(73) Assignee: BSH Hausgeräte GmbH, Munich (DE)

( * ) Notice: Subject to any disclaimer, the term of this patent is extended or adjusted under 35 U.S.C. 154(b) by 43 days.

(21) Appl. No.: 18/010,353

(22) PCT Filed: May 27, 2021

(86) PCT No.: PCT/EP2021/064183
§ 371 (c)(1),
(2) Date: Dec. 14, 2022

(87) PCT Pub. No.: WO2021/254759
PCT Pub. Date: Dec. 23, 2021

(65) Prior Publication Data

US 2023/0251027 A1 Aug. 10, 2023

(30) Foreign Application Priority Data

Jun. 19, 2020 (DE) ..... 10 2020 207 641.3

(51) Int. Cl.
*F25D 23/06* (2006.01)
*F25D 25/02* (2006.01)
*F25D 25/00* (2006.01)

(52) U.S. Cl.
CPC ..... *F25D 23/067* (2013.01); *F25D 25/02* (2013.01); *F25D 25/005* (2013.01); *F25D 2500/02* (2013.01)

(58) Field of Classification Search
CPC .... F25D 23/067; F25D 23/064; F25D 23/066; F25D 25/005; F25D 25/02; F25D 25/025; F25D 2500/02
See application file for complete search history.

(56) References Cited

U.S. PATENT DOCUMENTS 4,498,713 A 2/1985 Fellwock et al.
4,904,032 A 2/1990 Jenkins
4,914,341 A 4/1990 Weaver et al.

FOREIGN PATENT DOCUMENTS

GB 1411831 A 10/1975
KR 19990019300 A 3/1999

*Primary Examiner* — Kimberley S Wright
(74) *Attorney, Agent, or Firm* — Laurence A. Greenberg; Werner H. Stemer; Ralph E. Locher

(57) ABSTRACT

An interior compartment or container for a domestic refrigeration appliance has a side wall on which an elongate bearing rib for a bearing panel is integrated. The bearing rib extends in the depthwise direction of the interior compartment and extends over at least half the depth of the side wall. The bearing rib has an upper bearing side, which merges with the side wall by way of a first rounding and merges with an underside of the bearing rib by way of a second rounding, which is located opposite the first as seen in the widthwise direction. The underside merges at its lower end with the side wall. In a cross section of the bearing rib taken in a direction perpendicular to the longitudinal axis, a vertical-dimension ratio, measured in the heightwise direction, (Continued)

between an underside vertical dimension and an upper-side vertical dimension is between 3.5 and 4.5.

19 Claims, 7 Drawing Sheets

INTERIOR COMPARTMENT WITH A SPECIFIC SHAPE OF A BEARING RIB, AND DOMESTIC REFRIGERATION APPLIANCE

FIELD AND BACKGROUND OF THE INVENTION

One aspect of the invention relates to an internal container for a household refrigeration appliance. The internal container has a side wall on which an elongate bearing rib for a bearing panel is integrated. The bearing rib extends, by way of its longitudinal axis which is measured in the depth direction of the internal container, over at least half the depth of the side wall, as measured in this depth direction. The bearing rib has an upper bearing side. When viewed in cross section perpendicular to the longitudinal axis, the upper bearing side merges with the side wall by way of a first rounding. In this cross section, this upper bearing side merges with a lower side of the bearing rib by way of an opposing second rounding in the width direction of the internal container. The lower side of this bearing rib merges at its lower end with the side wall. Relative to an upper and a lower end, this is to be understood to be in the vertical direction of the internal container. A further aspect of the invention relates to a household refrigeration appliance having such an internal container.

In household refrigeration appliances it is known that a housing is formed from an external housing and an internal container arranged therein. The internal container is generally configured from plastic. For example, the internal container may be manufactured by deep-drawing. The internal container delimits a receiving space for food of the household refrigeration appliance by means of walls. Thermally insulating material, for example an insulating foam or vacuum insulation panels, is generally incorporated in an intermediate space between the internal container and the external housing.

Opposing bearing ribs are integrally formed on vertical side walls of the internal container. A separate bearing panel, such as for example a shelf or the like, may be positioned thereon.

In this context, many different embodiments of bearing ribs are known. In this regard, the bearing ribs may be configured as elongate or bar-like bearing webs.

Moreover, locally delimited, block-like elements which may be formed, for example, in the manner of a quarter moon, are also known.

In the case of these bearing ribs, generally several conditions have to be fulfilled. The bearing ribs have to be designed such that they are mechanically stable and thus are also able to bear in a stable manner such a bearing panel with stored goods optionally arranged thereon. Since, on the other hand, the bearing ribs are shaped in one piece from the material of the side wall, in particular by deep-drawing, these walls of the bearing rib have to be designed such that this stability is achieved. Thus the bearing ribs should not be too thin, since otherwise the stability is reduced. However, a shape which permits the intermediate space to be completely filled with thermally insulating material is also expedient, and thus in this context the bearing rib may also be completely filled with this thermal material on the side thereof facing the external housing.

Moreover, in the case of the internal container it is provided that, when viewed in the vertical direction, a plurality of bearing ribs are configured at different vertical positions on a side wall. As a result, a bearing panel may also be attached at different insertion planes in the container or a plurality of separate bearing panels may be attached simultaneously at different vertical positions. In order to permit simple handling for removing the bearing panel, on the one hand, and the application of such a bearing panel on a bearing rib, on the other hand, an advantageous shape also has to be provided in this regard. As a result, this is intended to provide simple handling and to avoid undesired impact against a bearing rib configured thereabove.

SUMMARY OF THE INVENTION

It is the object of the present invention to provide an internal container which is designed specifically in terms of shape such that, on the one hand, it has a high degree of stability and, on the other hand, the handling for removing and attaching bearing panels is made possible in a user-friendly manner.

This object is achieved by an internal container and a household refrigeration appliance as claimed in the independent claims.

One aspect of the invention relates to an internal container for a household refrigeration appliance. The internal container has a vertical side wall. At least one elongate bearing rib is integrated on this side wall and thus is configured in one piece with this side wall. The bearing rib is designed, in particular, in a bar-like manner or as an elongate web. The bearing rib is thus larger in terms of its length than in width and height. In particular, in this regard the bearing rib is at least twice as long as it is wide and high. The bearing rib has a longitudinal axis which extends in the depth direction of the internal container. The bearing rib extends, in particular, over at least half the depth of the side wall, as measured in the depth direction. In this regard, the length of the bearing rib along this longitudinal axis is thus configured over at least half of this side wall. The bearing rib has an upper bearing side for positioning the bearing panel. When viewed in the width direction of the internal container and in a cross section perpendicular to the longitudinal axis, the bearing panel merges with the side wall by way of a first rounding. When viewed in the width direction of the internal container and in cross section, this upper bearing side merges with a lower side of the bearing rib by way of an opposing second rounding. When viewed in cross section, this lower side merges at its lower end with the side wall. This lower side merges at its upper end with this second rounding.

In particular, in the cross section of the bearing rib which is oriented perpendicular to the longitudinal axis, in an advantageous exemplary embodiment the bearing rib preferably has a vertical-dimension ratio, measured in the vertical direction of the internal container, between a lower side vertical dimension and an upper side vertical dimension. This advantageous vertical dimension is measured between the value 3.5 and 4.5, in particular between 3.8 and 4.2. The lower side vertical dimension extends in this vertical direction between an upper end of the lower side and a lower end of the lower side. The upper side vertical dimension extends in this vertical direction between an upper end of the first rounding and a lower end of the second rounding. The lower side vertical dimension is thus a dimension measured in a straight line in the vertical direction. The upper side vertical dimension is also a dimension measured in a straight line in the vertical direction.

The above-mentioned advantages are achieved by such a cross-sectional geometry of the bearing rib. In this regard, the bearing rib is mechanically stable and resilient and is also able to be created relatively accurately in terms of shape. In particular, this rib geometry of the side wall may be accurately generated by thermoforming. When viewed in cross section, the above-mentioned requirements may also be fulfilled by this particular dimensioning of the specifically defined portions of this bearing rib, particularly advantageously in combination.

In particular, this aforementioned cross-sectional shape of the bearing rib is configured at least at one point along the longitudinal axis. When viewed along the longitudinal axis, this at least one point is preferably configured on a front longitudinal half of the bearing rib. In particular, when viewed along the longitudinal axis, it is provided that this vertical-dimension ratio is configured over at least a third, in particular at least half, in particular at least 90 percent, of the length of the bearing rib. As a result, the requirements for stability, corresponding shapeability and user-friendly handling of a bearing panel for removing and placing on a bearing rib are taken into account in a particularly advantageous manner. In particular, when a plurality of bearing ribs are configured at different vertical positions, therefore, the handling of a bearing panel on a lower bearing rib may also be carried out in a manner which is very user-friendly and simple, since in this regard the upper bearing rib still provides sufficient free space in the vertical direction, in particular due to the geometry of the lower side.

In an exemplary embodiment it is provided that, when viewed in the direction of the longitudinal axis, the lower side of the bearing rib is shaped in an S-shaped manner at least at one point in a cross section perpendicular to the longitudinal axis. Such a shaping assists the above-mentioned aspects to a particular degree. The high deformation stability, high load-bearing capacity and even a relatively large amount of free space toward the bottom is provided by such a geometry, in particular of the lower side.

Preferably, when viewed in this cross section, this S-shape does not have a straight portion.

Preferably, this cross-sectional dimension of the lower side is configured with an S-shape in a front half of the total length of the bearing rib. In particular, such an S-shape is configured over at least 50 percent, in particular at least 60 percent, in particular at least 70 percent, in particular at least 80 percent, of the front half of the length of the bearing rib.

In an exemplary embodiment it is provided that, when viewed in cross section, a vertical dimension of an upper S-shaped part of this S-shape is smaller than a vertical dimension of a lower S-shaped part of this S-shape. This also fulfills the aspect of stability, easy shapeability, with a thickness of the wall of the bearing rib which is as uniform as possible over the entire cross-sectional geometry, and also sufficient free space, when viewed in the width direction, which is also of a correspondingly large size in the vertical direction.

In particular, it is provided that, when viewed in the direction of the longitudinal axis, the vertical-dimension ratio between the S-shaped parts is configured over at least a third, in particular at least half, of the bearing rib. The above-mentioned aspects are also advantageously assisted thereby.

In particular, it is provided that, when viewed in cross section, a curvature of the upper S-shaped part is larger than a curvature of the lower S-shaped part. In this regard, the lower side is additionally stabilized and thus may have a high load-bearing capacity. An advantageous force deflection from this lower side into the side wall is permitted thereby. In particular, it is provided that, when viewed in the depth direction of the internal container and thus when viewed along the longitudinal axis of the bearing rib, the curvature of the upper S-shaped part becomes larger from the front to the rear. Additionally or alternatively, this also applies to the lower S-shaped part.

In an advantageous exemplary embodiment, when viewed from the front to the rear, these curvatures approach one another. In particular, when viewed from the front to the rear, these curvatures transition continuously into larger values, in particular when viewed in cross section they terminate at the rear end of the bearing rib in a vertical straight line. The lower side thus has a specific pan-shaped bulged portion in at least two directions. This is formed by the S-shape. When viewed from the front to the rear, this S-shape changes continuously so that in a rear region of the bearing rib it is completely eliminated and thus an S-shape is no longer present in cross section. Thus the bearing rib in its rear region, in particular in its rear end, is formed as a straight cross section over the entire height of its lower side. Thus in this regard the bearing rib is bulged to a maximum extent inwardly into the receiving space of the internal container.

In an exemplary embodiment it is provided that, when viewed in cross section, the upper S-shaped part is bulged away from the side wall. In this regard, a convex curvature is formed. The lower S-shaped part is bulged toward the side wall. Thus the lower S-shaped part forms a wall portion which is curved in a concave manner. As a result, the above-mentioned advantages are specifically fulfilled and the requirements, as have been mentioned above, are particularly taken into account.

In particular, it is provided that, when viewed along the longitudinal axis, in the region of the bearing rib in which the lower side has an S-shape in cross section, a curvature of an upper S-shaped part of the S-shape in the vertical direction reduces from the front to the rear, in particular continuously. Additionally or alternatively, it may be provided that, when viewed along the longitudinal axis, in the region of the bearing rib in which the lower side has an S-shape in cross section, a curvature of a lower S-shaped part of the S-shape in the vertical direction reduces from the front to the rear, in particular continuously.

In an exemplary embodiment it is provided that, when viewed along the longitudinal axis, in cross section in the region of the bearing rib in which the lower side has an S-shape in cross section, this S-shape widens from the front to the rear and at a rear region of the bearing rib the S-shape in cross section transitions continuously into a straight line or a straight line is formed at the rear end of the cross-sectional shape.

In a further exemplary embodiment, it is provided that, when viewed along the longitudinal axis, the upper bearing side tapers from a starting point in a front longitudinal third, in particular a front longitudinal quarter, of the bearing rib to the rear, in particular continuously. It is achieved by means of such an embodiment that an upper bearing side which is as wide as possible is formed in the front region. In principle, when the bearing panel is introduced it may be already placed securely at the front and then pushed to the rear. Since a bearing panel also bears in the width direction against the opposing side walls with a certain clearance on the opposing bearing ribs, by this dimensioning of the upper bearing side the bearing panel is also prevented from undesirably dropping down to the side. Since in this regard the bearing panel is wider at the front, a relative displacement of the bearing panel in the width direction, such that the bearing panel might drop down, is not able to take place. Moreover, by such an embodiment it is also achieved that a maximum width dimension may be made available in the rear region of the internal container, in particular in the region of the rear wall of the internal container. This is advantageous in that in this rear region in the internal container, therefore, a maximum required space may be provided in the width direction for a component of a refrigeration circuit of the household refrigeration appliance. In particular, therefore, an evaporator may be positioned in this rear region of the internal container with maximum width.

In an advantageous exemplary embodiment it is provided that a niche for receiving a rear end of the bearing panel is integrated and thus is configured in one piece on the side wall. When viewed in the depth direction, the niche is configured such that it directly adjoins the bearing rib toward the rear. The niche has a top wall. When viewed in the depth direction of the internal container, this top wall also extends above this upper bearing side. Thus, in the depth direction, an overlapping arrangement is also configured between the top wall and the upper bearing side. Thus in the rear region of the bearing rib a portion is formed which is delimited toward the bottom by the upper bearing side and toward the top by the top wall. This is advantageous in that a stop for the applied bearing rib is formed toward the top by the top wall. If the bearing panel were to be acted upon in the front region by force from above, such that it might tilt up to the rear, it is possible to prevent the bearing panel from completely tilting out to the front. This is because the rear region of the bearing panel would then strike against this top wall. This also means, therefore, that, when viewed in the width direction of the internal container, the top wall extends over a dimension such that the bearing panel is prevented from tilting too far upwardly. In particular, therefore, a clear width measured in the width direction between two such opposing top walls of bearing ribs applied in the same vertical direction on the side walls is smaller than this dimension of the bearing panel measured in the width direction.

In particular, it is provided that this top wall extends to a maximum extent over the rear longitudinal half of the bearing rib. In particular, it is also provided that, when viewed from the rear to the front, the top wall tapers. When viewed along the longitudinal axis, the top wall is thus configured to increase from the front to the rear in the width direction of the internal container.

In an exemplary embodiment it may be provided that the first rounding, when viewed in cross section, is configured at least approximately with a radius of between 2 mm and 4 mm, in particular of between 2.5 mm and 3.5 mm. It may be provided that, when viewed over its entire length, this first rounding does not have a uniform radius but has a changing radius and this radius value is configured at least at one point. The second rounding may advantageously have in cross section a radius of between 2.5 mm and 4.5 mm, in particular of between 3 mm and 4 mm. It may also be provided here that, when viewed over its entire length, this first rounding does not have a uniform radius but also has a changing radius and has this radius value at least at one point.

In an advantageous exemplary embodiment it is provided that, when viewed in cross section, a radius of the upper S-shaped part is between 7.5 mm and 15.5 mm, in particular between 8 mm and 15 mm. It is also possible here that the radius changes over the entire length of this upper S-shaped part and this radius value is configured at least at one point. In a lower S-shaped part, when viewed in cross section, a radius may be provided of between 19 mm and 31 mm, in particular of between 20 mm and 30 mm. In particular, it is also provided here that the radius changes over the entire length of this lower S-shaped part and this radius value is configured at least at one point.

In an exemplary embodiment it is provided that, when viewed in the direction of its longitudinal axis, a bearing rib tapers relative to its upper bearing side. In this context, starting from a starting point of the upper bearing side, in particular that protruding furthest inwardly in the width direction—spaced furthest apart from the side wall—a continuous tapering of the upper bearing side is configured to the rear in the depth direction. However, the tapering does not extend as far as the side wall. At the rear end, therefore, the upper bearing side has a width of greater than zero. From this starting point toward the front, a tapering of this upper bearing side is also formed, in particular until the width is zero. When viewed in the width direction, the starting point is thus the point spaced apart to a maximum extent from the side wall. In particular, in this regard a width reduction of at least 10 percent, in particular at least 20 percent, in particular at least 30 percent, in particular a maximum of 50 percent, of the width at the starting point is formed at the rear end 17 of the bearing rib 13.

A further width b1 of the bearing rib is measured at the point at which the bearing rib is shown with its maximum contour in cross section. This is the maximum extent of the wave shape of the bearing rib formed in cross section. This maximum contour is configured over the entire length of the bearing rib at the same vertical position.

In particular, at this starting point a width-to-height ratio of the bearing rib and thus the ratio b1/(h1+h2) is between 0.4 and 0.6, in particular between 0.45 and 0.55. This width b1 is measured relative to the first rounding on the outer face of the first rounding. However, this width may also be measured on the inner face so that then the width b results, as has been mentioned above. Thus the difference between the width b and the width b1 is only the thickness of the wall. Conventional wall thicknesses which are provided in deep-drawing are configured therefor.

Preferably, starting from the starting point the width b1 changes continuously to the rear. At the rear end of the bearing rib this width b1 is different from zero. In particular, the width at this rear end is between 25% and 40%, in particular between 30% and 35%, less than the width b1 at the starting point. In particular, the height h1+h2 of the bearing rib is the same over at least 80%, in particular at least 90%, of the length. In particular, the height h1+h2 remains the same from the starting point to the rear end. In particular, therefore, the width-to-height ratio may also be determined at the different longitudinal positions of the bearing rib.

At the front end of the bearing rib, the maximum contour terminates directly on the side wall so that here at the front the width b is equal to zero or the width b1 corresponds only to the wall thickness.

A further aspect of the invention relates to a household refrigeration appliance having a housing. This housing has, in particular, an external housing and an internal container which is separate therefrom. The internal container is configured according to the above-mentioned aspect or an advantageous embodiment thereof. In particular, the internal container is received in the external housing. The internal container delimits a receiving space for food by means of the walls.

In particular, the embodiment permits a geometry for a bearing rib which in an improved manner fulfills many different aspects individually and as a whole. The very soft shape transitions make it possible for fewer internal stresses to occur during the shaping and thus when manufacturing such bearing ribs. Thus stress cracks occurring in the event of a temperature change may also be avoided in an improved manner. A simple manufacture is also permitted by these very soft shape transitions generated over longer distances on the bearing rib.

Nevertheless, the walls may be manufactured with a relatively uniform thickness. In particular, in this context it is also possible that thinner walls of this bearing rib may be generated in comparison with conventional geometries and shapes of bearing ribs, and at least a uniform stability is still achieved.

Further independent aspects emerge from the individual embodiments in the above-mentioned examples which do not necessarily have the features, in particular not necessarily the characterizing features, of the above-mentioned first independent aspect, in particular of the independent internal container claim.

Positions and orientations provided when the internal container or the internal container or the appliance are used as intended and arranged as intended are specified by the terms "above", "below", "front", "rear", "horizontal", "vertical", "depth direction", "width direction", "vertical direction", etc.

Further features of the invention emerge from the claims, the figures and the description of the figures. The features and combinations of features mentioned above in the description and the features and combinations of features mentioned hereinafter in the description of the figures and/or shown individually in the figures are not only able to be used in the respectively specified combination but also in other combinations or individually without departing from the scope of the invention. Thus embodiments of the invention, which are not explicitly shown and explained in the figures but which emerge and may be generated by separate combinations of features from the described embodiments, are also to be regarded as encompassed and disclosed. Embodiments and combinations of features which thus do not have all of the features of an originally formulated independent claim are also to be regarded as disclosed.

Exemplary embodiments of the invention are explained in more detail hereinafter with reference to schematic drawings. In the drawings:

DETAILED DESCRIPTION OF THE INVENTION

Figure 1:
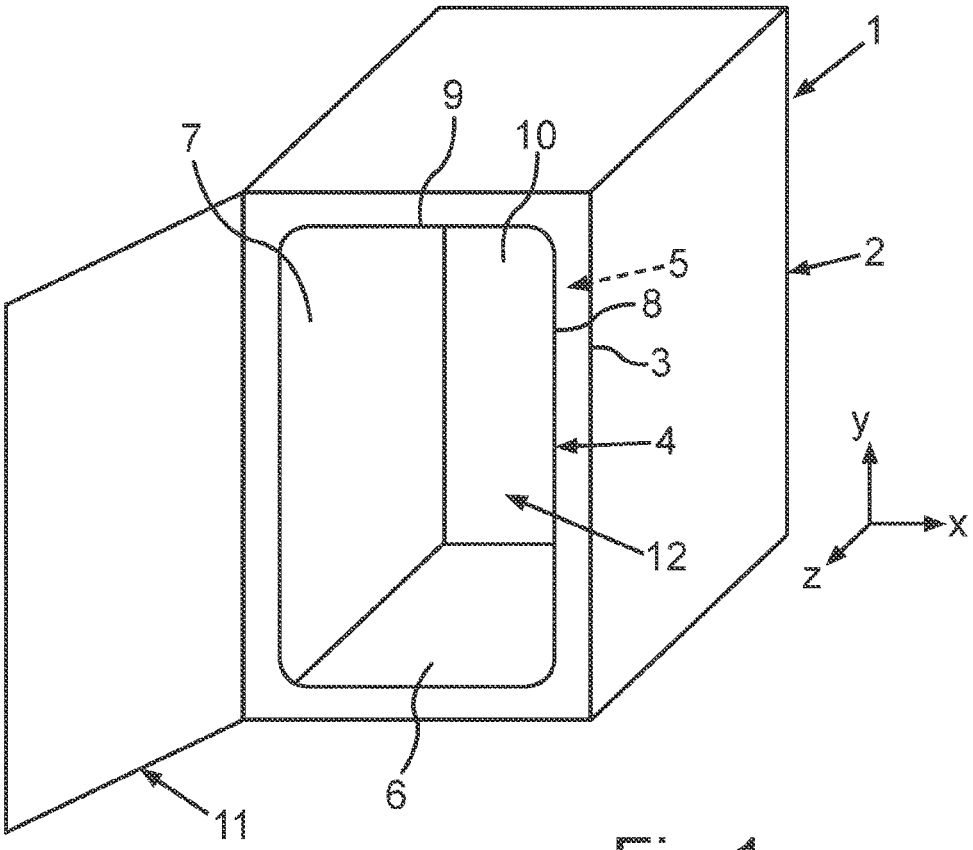
FIG. 1 shows a perspective view of an exemplary embodiment of a household appliance according to the invention with an exemplary embodiment of an internal container according to the invention.

Elements which are the same or functionally the same are provided with the same reference characters in the figures.

In FIG. 1 a schematic view of a household refrigeration appliance 1 is shown. The household refrigeration appliance 1 is configured for storing and conserving food. The household refrigeration appliance 1 may be a refrigerator or a freezer or a fridge-freezer.

The household refrigeration appliance 1 has a housing 2. This housing has an external housing 3. Moreover, this housing 2 also has an internal container 4 which is separate from the external housing 3. The internal container 4 is received in the external housing 3. A thermally insulating material 5 is incorporated in an intermediate space between the external housing 3 and the internal container 4. The internal container 4 has a bottom wall 6, a first vertical side wall 7, an opposing second vertical side wall 8, a top wall 9 and a rear wall 10. The loading opening on the front side of the internal container 4 is closable by a door 11 of the household refrigeration appliance 1.

A receiving space 12 for food is delimited by the walls 6 to 10 of the internal container 4.

The internal container 4 is preferably manufactured in one piece. The internal container is manufactured, in particular, from plastic. In particular it may be manufactured, for example, by deep-drawing.

Figure 2:
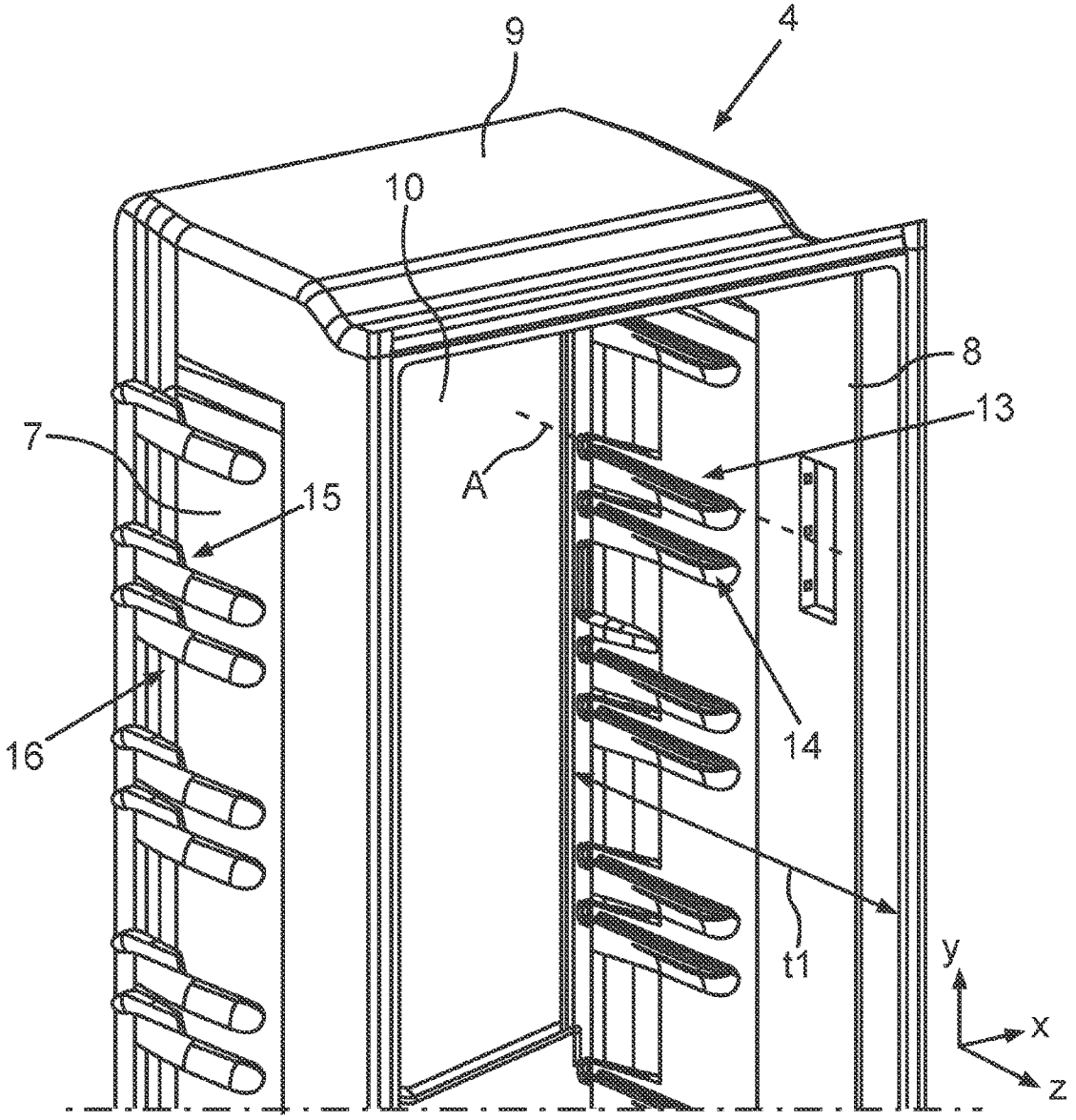
FIG. 2 shows a perspective partial view of an exemplary embodiment of an internal container.

In FIG. 2 a sub-region of the internal container 4 is shown in a perspective view. As may be identified here, different bearing ribs are configured on the side wall 8 at different vertical positions, when viewed in the vertical direction (x-direction). For the sake of clarity, two bearing ribs are provided here with the reference characters 13 and 14. Corresponding bearing ribs are formed in one piece on the opposing vertical side wall 7. Also here for the sake of clarity, only two such bearing ribs are provided with the reference characters 15 and 16.

The bearing ribs in each case in pairs form a bearing device for a bearing panel, not shown. The bearing panel is a separate component from the internal container 4. The bearing panel may be a shelf or a partition or another panel-like cover. The bearing ribs 13 and 14 and 15 and 16 are manufactured in one piece with the internal container 4.

The side wall 8 has a depth t1 measured in the depth direction (z-direction). A bearing rib 13 has a longitudinal axis A, as shown in the side view in FIG. 3, which shows a partial detail of the side wall 8. This longitudinal axis A extends in the depth direction. The length l1 of this bearing rib 13 measured along this longitudinal axis A is greater than half of the depth t1. As may be identified, the bearing rib 13 is formed as an elongated rail or as a bar-like support. The further bearing ribs 14, 15 and 16 are correspondingly formed.

As may be identified, when viewed in the depth direction, a niche 18 directly adjoins this bearing rib 13, in particular at a rear end 17 of the bearing rib 13. This niche 18 is configured for receiving a rear end of a bearing panel. As may be identified, when viewed in the vertical direction (y-direction), this receiver or this niche 18 is formed further toward the bottom than an upper bearing side 19 of the bearing rib 13. As a result, the rear end or a coupling element of the bearing panel is also mounted in the inserted end position so as to be protected against being pulled out.

The niche 18 is delimited both toward the bottom and toward the rear and toward the top. In this regard, the niche has a top wall 20. As may be identified, this top wall 20 also extends in this depth direction so as to overlap with the upper bearing side 19 of the bearing rib 13. In particular, this top wall 20 extends above the upper bearing side 19 over the length of the rear longitudinal third of the bearing rib 13, in particular to a maximum extent over the length of the rear longitudinal half of the bearing rib 13.

This top wall 20 is also configured in the width direction such that a certain guide channel is also formed by this top wall 20 and the upper bearing side 19. An anti-tilt element for the bearing panel is also formed by the top wall 20. The bearing panel thus is not able to tilt out to the front in an undesirable manner.

In particular, it is provided that, when viewed in the width direction (x-direction), the extent of the top wall 20 changes from its front end 20*a* to its rear end 20*b*, in particular becomes larger toward the rear end 20*b*. In particular, in this regard a continuous increase is formed.

Figure 3:
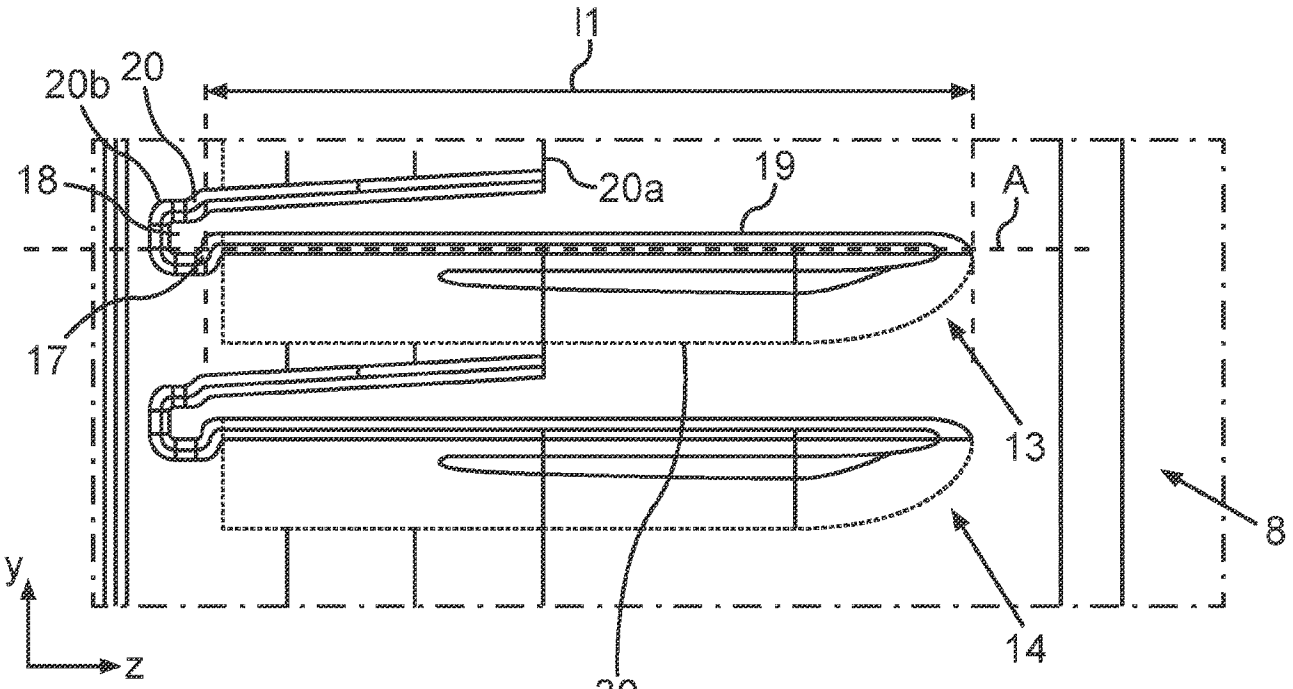
FIG. 3 shows a drawing of a side view of a sub-region of a side wall of the internal container according to FIG. 2.
Figure 4:
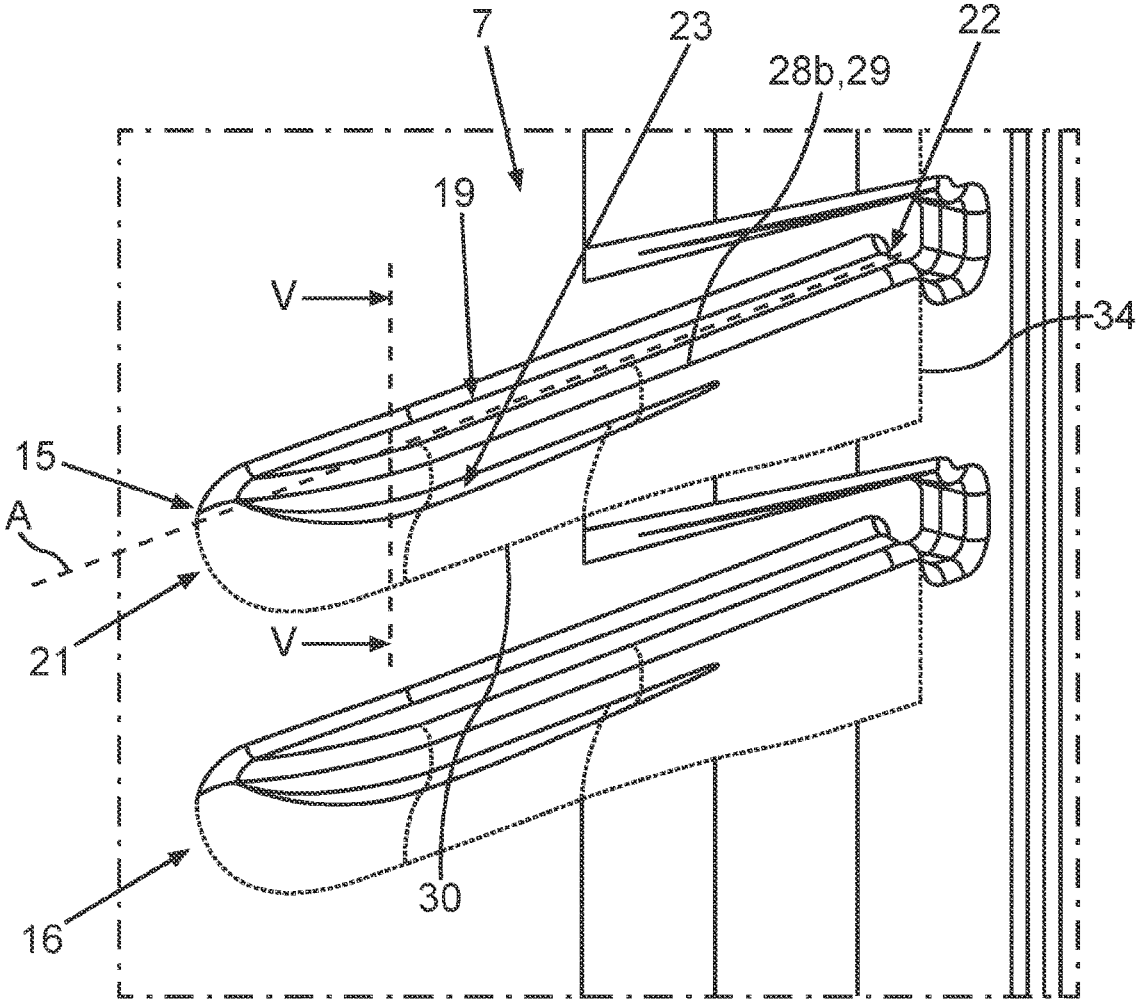
FIG. 4 shows a perspective view of a sub-region of an opposing side wall of the internal container relative to FIG. 3.
Figure 5:
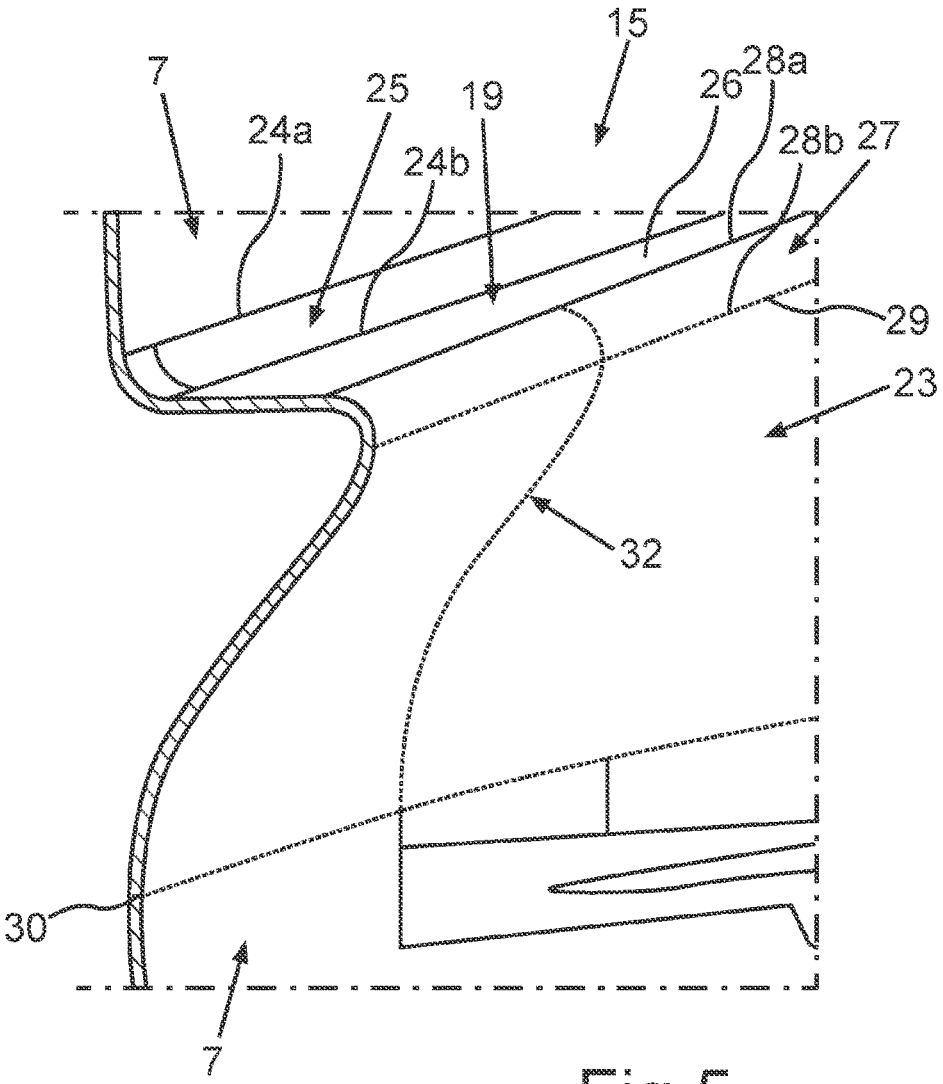
FIG. 5 shows a perspective sectional view of a bearing rib as is contained in the side wall according to FIG. 4.

In FIG. 3 and FIGS. 4 and 5 the shape of the bearing ribs is also partially identified by dashed lines. This is not only intended to show the points at which the geometry of the bearing rib steplessly transitions into the respective side wall. The geometric boundary of the bearing rib is shown by the dashed lines. The individual regions of the bearing rib itself also transition, in particular steplessly, into one another. As a result, particularly soft transitions without edges are generated. Dashed lines shown in the bearing rib itself are intended to serve as auxiliary lines for understanding the contour path, in particular in the region of the lower side of the bearing rib.

In FIG. 4 the sub-region of the side wall 7 is shown in a perspective view, wherein the bearing ribs 15 and 16 are shown here. The bearing rib 15 has a front end 21 and a rear end 22. Regarding the embodiment of a niche with a top wall, reference should be made to the explanations relative to FIG. 3.

As may be identified, a bearing rib has an individual three-dimensional shape. In particular, this shape of a bearing rib is similar to a half of a ship's hull, wherein the half is to be seen in this regard relative to a vertical plane which encompasses the longitudinal axis of the ship. In this regard, the front end 21 is to be seen in the form of a bow of such a ship's hull.

In this context, it may also be identified that the bearing rib 15 is specifically shaped three-dimensionally in a lower side 23. In this context, according to the perspective sectional view in FIG. 5, the bearing rib 15 may be viewed at the point of the cutting plane V-V. The bearing rib 15, when viewed in the vertical direction, merges at an upper end 24*a* with the side wall 7, in particular steplessly. In this context, a first rounding 25 which has this upper end 24*a* is configured. The first rounding 25 is a constituent part of the upper bearing side 19. This upper bearing side 19 has a flat region 26 adjoining a lower end 24*b* of this first rounding 25. This flat region extends substantially perpendicular to the side wall 7. A second rounding 27 which is a constituent part of the upper bearing side 19 is configured so as to adjoin this flat region 26. The second rounding 27 directly adjoins the region 26 with an upper end 28*a*. When viewed in the vertical direction, a lower end 28*b* is formed, the upper bearing side 19 being delimited thereby. The lower end 28*a* is also the lower end of the second rounding 27. The lower side 23 of the bearing rib 15 is formed so as to adjoin directly this upper bearing side 19. The lower side 23 directly adjoins the lower end 28*b* with an upper end 29. A lower end 30 of the lower side 23 in the vertical direction is also shown in FIG. 5.

Figure 6:
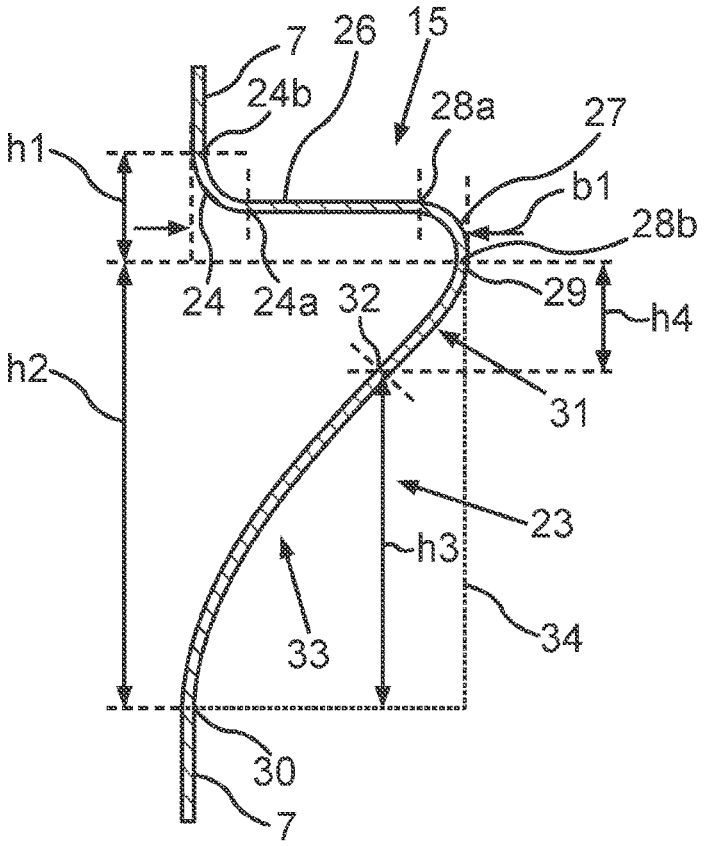
FIG. 6 shows a front view of the sectional view according to FIG. 5.

In FIG. 6 the bearing rib 15 is shown in the cutting plane V-V. As may be identified in the exemplary embodiment, the cross section is formed in a front longitudinal half of the bearing rib 15 in the depth direction. In particular, it is provided here that the lower side 23 is configured in an S-shaped manner. In the exemplary embodiment this S-shape does not have a linear portion. In particular, this S-shape has an upper S-shaped part 31. This upper S-shaped part extends from the upper end 29 to an intermediate point 32. The upper S-shaped part 31 terminates at this intermediate point 32. A lower S-shaped part 33 of the S-shape extends from this region of the intermediate point 32 to the lower end 30. As may be identified, the S-shaped parts 31 and 33 have different curvatures. The upper S-shaped part 31 is bulged away from the side wall 7 and thus bulged toward the receiving space 12. In this regard, the curvature of the lower S-shaped part 33 is in the other direction. The bulging is thus provided toward the side wall 7. In particular, the lower S-shaped part 33 is curved in a concave manner and the upper S-shaped part 31 is curved in a convex manner.

In particular, a stepless transition is configured at the intermediate point 32 between the S-shaped parts 31 and 33. In particular, a stepless transition is configured between the lower side 23 and the side wall 7 at the lower end 30. In particular, a stepless transition is configured at all points of the contour of a bearing rib in which the aforementioned partial elements transition into one another.

As may be identified in FIG. 6 the upper bearing side 19 has an upper side vertical dimension h1. This is measured in the vertical direction and is measured between the upper end 24*a* and the lower end 28*a*. The lower side 23 has a lower side vertical dimension h2. This is measured between the upper end 29 and the lower end 30. As may be identified, the upper side vertical dimension h1 is smaller than the lower side vertical dimension h2. In particular, a vertical-dimension ratio between the lower side vertical dimension h2 and the upper side vertical dimension h1 is between 3.5 and 4.5, in particular between 3.8 and 4.2. Preferably, this vertical-dimension ratio is configured over at least 50 percent, in particular at least 60 percent, in particular at least 70 percent, in particular at least 80 percent, in particular at least 90 percent, of the length of the bearing rib measured in the direction of the longitudinal axis A.

In particular, this vertical-dimension ratio between the lower side vertical dimension h2 and the upper side vertical dimension h1 is constant over the length of the bearing rib 15.

Moreover, it may also be identified that a vertical dimension h4 of the upper S-shaped part 31 is smaller than a relevant vertical dimension h3 of the lower S-shaped part 33. In particular, the vertical dimension h3 of the lower S-shaped part 33 is at least double the size of the vertical dimension h4 of the upper S-shaped part 31. Here these vertical dimensions h3, h4 are measured in the vertical direction and measured, on the one hand, between the upper end 29 and the intermediate point 32, and, on the other hand, between the intermediate point 32 and the lower end 30.

Preferably, the bearing rib 15, when viewed along its longitudinal axis A, has such an S-shape of the lower side 33 over at least 50 percent of its length, in particular at least 60 percent of its length, in particular at least 70 percent of its length, in each case viewed in cross section.

This may also be identified in FIG. 3 and FIG. 4.

Moreover, in particular it may be identified from FIG. 4 and FIG. 5 that the S-shape, when viewed along the longitudinal axis A, continuously changes in cross section. In particular, it is provided that this S-shape widens, when viewed from the front to the rear. This means that, when viewed from the front to the rear, the curvature of the S-shape in the S-shaped upper part 31 reduces or becomes smaller, in particular becomes continuously smaller. In particular, the same is also provided for the curvature of the lower S-shaped part 33. As may also be identified in FIG. 4 and FIG. 3, the bearing rib 15 at its rear end 22 is no longer formed with an S-shape of the lower side 23 in cross section but with a straight line 34 in this cross section. This means that from the front to the rear the lower side 23 continuously changes from an S-shape transitioning into a vertical straight line 34. In turn, the lower side vertical dimension h2 also applies to the straight line 34, in particular. This means that the lower side 23 bulges the most toward the side wall 7 at the front region, and this bulging toward the side wall 7 reduces to the rear such that at the rear end 22 only the straight line 34 is formed in cross section. In this regard, for better understanding of the shape, in FIG. 6 this straight line 34 is illustrated as dashed vertical line as an auxiliary line.

Figure 7:
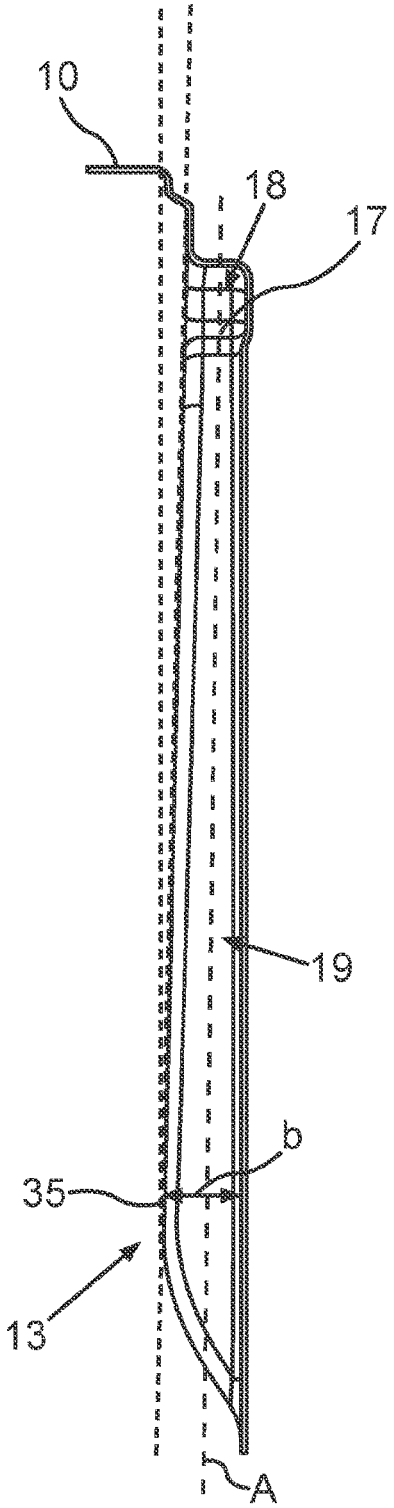
FIG. 7 shows a plan view of a bearing rib as is contained in the side wall according to FIG. 3.

In an exemplary embodiment, as may be identified in the plan view according to FIG. 7, it is provided that a bearing rib, when viewed in the direction of its longitudinal axis, tapers relative to its upper bearing side 19. In this context, a continuous tapering of the upper bearing side 19 is formed, starting from a starting point 35 in the depth direction to the rear. A tapering of this upper bearing side 19 is also formed from this starting point 35 to the front. Thus the starting point 35, when viewed in the width direction, is the point spaced apart to a maximum extent from the side wall 8. In particular, in this regard a width reduction by at least 10 percent, in particular at least 20 percent, in particular at least 30 percent, in particular a maximum of 50 percent, of the width b at the starting point 35 is formed at the rear end 17 of the bearing rib 13. The width b is measured on the inner face of the first rounding 24.

In particular, the section in FIG. 6 is at the starting point 35 so that this section is located in the cutting plane. In the width direction x the upper bearing side 19 has the greatest width at this point of the starting point 35.

In FIG. 6 a width b1 of the bearing rib 15 is also shown. This width b1 is measured at the point at which the bearing rib 15 is shown with its maximum contour. This is the maximum wave shape of the bearing rib 15 formed in cross section. This maximum contour is configured over the entire length of the bearing rib 15 at the same vertical position. In particular, this is at the point of the lower end 28*b* in the vertical direction.

In particular, in FIG. 6 the contour and thus the cross-sectional geometry is shown at this starting point 35. In particular, a width-to-height ratio of the bearing rib 15 and thus the ratio b1/(h1+h2) is between 0.4 and 0.6, in particular between 0.45 and 0.55. This width b1 is measured relative to the first rounding 24 on the outer face of the first rounding 24. However, the width may also be measured on the inner face, so that then the width b results. The difference between the width b and the width b1 is thus only the thickness of the wall. Conventional wall thicknesses which are provided in deep-drawing are configured therefor.

Preferably, the width b1 starting from the starting point 35 continuously changes to the rear. At the rear end 17 this width b1 is different from zero. In particular, the width at this rear end 17 is between 25% and 40%, in particular between 30% and 35%, less than the width b1 at the starting point 35. In particular, the height h1+h2 of the bearing rib 15 is the same over at least 80%, in particular 90% of the length. In particular, the height h1+h2 from the starting point 35 to the rear end 17 remains the same. In particular, therefore, the width to height ratio may also be determined at the different length positions of the bearing rib 15.

At the front end of the bearing rib 15 the maximum contour terminates directly on the side wall 7, so that here at the front the width b is equal to zero or the width b1 corresponds only to the wall thickness.

LIST OF REFERENCE CHARACTERS

1 Household refrigeration appliance
2 Housing
3 External housing
4 Internal container
5 Thermally insulating material
6 Bottom wall
7 First vertical side wall
8 Second vertical side wall
9 Top wall
10 Rear wall
11 Door
12 Receiving space
13 Bearing rib
14 Bearing rib
15 Bearing rib
16 Bearing rib
17 Rear end
18 Niche
19 Upper bearing side
20 Top wall
20*a* Front end
20*b* Rear end
21 Front end
22 Rear end
23 Lower side
24*a* Upper end
24*b* Lower end
25 First rounding
26 Region
27 Second rounding
28*a* Upper end
28*b* Lower end
29 Upper end
30 Lower end
31 Upper S-shaped part
32 Intermediate point
33 Lower S-shaped part
34 Straight line
35 Bearing point
A Longitudinal axis
b Width
b1 Width
x Vertical direction
y Vertical direction
z Depth direction
h1 Upper side vertical dimension
h2 Lower side vertical dimension
h3 Vertical dimension
h4 Vertical dimension
l1 Length
t1 Depth

The invention claimed is:

1. An internal container for a household refrigeration appliance, the internal container comprising:

a side wall on which an elongate bearing rib for a bearing panel is integrated, wherein said elongate bearing rib extends, by way of its longitudinal axis, in a depth direction of the internal container and extends over at least half a depth of the side wall, as measured in the depth direction, wherein said elongate bearing rib has an upper bearing side, which merges with said side wall by way of a first rounding and merges with a lower side of said elongate bearing rib by way of an opposing second rounding in a width direction of the internal container, wherein said lower side merges at its lower end with said side wall, and in a cross section of said elongate bearing rib perpendicular to the longitudinal axis a vertical-dimension ratio, measured in a vertical direction of the internal container, between a lower side vertical dimension, which is measured between an upper end of said lower side and a lower end of said lower side, and an upper side vertical dimension which is measured between an upper end of said first rounding and a lower end of said second rounding, is between 3.5 and 4.5; and a niche for receiving a rear end of a bearing panel being integrated on said side wall, wherein said niche directly adjoins said elongate bearing rib toward a rear, wherein, when viewed in the depth direction of the internal container, said niche also extending with a top wall above said upper bearing side.

2. The internal container according to claim 1, wherein when viewed along the longitudinal axis, the vertical-dimension ratio is configured over at least a third of a length of said elongate bearing rib.

3. The internal container according to claim 1, wherein when viewed in a direction of the longitudinal axis, said lower side is shaped in an S-shaped manner at least at one point in a cross section perpendicular to the longitudinal axis.

4. The internal container according to claim 3, wherein said lower side being S-shaped has an upper S-shaped part and a lower S-shaped part, a vertical dimension of said upper S-shaped part is smaller than a vertical dimension of said lower S-shaped part.

5. The internal container according to claim 4, wherein when viewed in the direction of the longitudinal axis, a vertical-dimension ratio between said upper and lower S-shaped parts is configured over at least a third of a length of said elongate bearing rib.

6. The internal container according to claim 4, wherein a curvature of said upper S-shaped part is larger than a curvature of said lower S-shaped part.

7. The internal container according to claim 4, wherein said upper S-shaped part is bulged away from said side wall and said lower S-shaped part is bulged toward said side wall.

8. The internal container according to claim 4, wherein when viewed along the longitudinal axis, in a region of said elongate bearing rib in which said lower side has said S-shape in cross section, a curvature of said upper S-shaped part of said S-shape in the vertical direction reduces from a front to a rear, and/or, when viewed along the longitudinal axis, in said region of said elongate bearing rib in which said lower side has said S-shape in cross section, a curvature of said lower S-shaped part of said S-shape in the vertical direction reduces from a front to a rear.

9. The internal container according to claim 3, wherein when viewed along the longitudinal axis, in a region of said elongate bearing rib in which said lower side has said S-shape in cross section, said S-shape widens from a front to a rear and at a rear region of said elongate bearing rib said S-shape in cross section transitions continuously into a straight line.

10. The internal container according to claim 1, wherein when viewed along the longitudinal axis, said upper bearing side tapers from a starting point in a front longitudinal third of said elongate bearing rib to a rear.

11. The internal container according to claim 1, wherein when viewed along the longitudinal axis, said upper bearing side tapers from a starting point in a front longitudinal third of said elongate bearing rib to a front.

12. The internal container according to claim 1, wherein said top wall extends to a maximum extent over a rear longitudinal half of said elongate bearing rib.

13. The internal container according to claim 1, wherein when viewed along the longitudinal axis, said top wall increases from a front to a rear in a width direction of the internal container.

14. The internal container according to claim 1, wherein the vertical-dimension ratio is between 3.8 and 4.2.

15. The internal container according to claim 1, wherein when viewed along the longitudinal axis, the vertical-dimension ratio is configured over at least half of a length of said elongate bearing rib.

16. The internal container according to claim 1, wherein when viewed along the longitudinal axis, the vertical-dimension ratio is configured over at least 90% of a length of said elongate bearing rib.

17. The internal container according to claim 4, wherein when viewed in the direction of the longitudinal axis, a vertical-dimension ratio between said upper and lower S-shaped parts is configured over at least a half of the length of said elongate bearing rib.

18. The internal container according to claim 1, wherein when viewed along the longitudinal axis, said upper bearing side tapers from a starting point in a front longitudinal of said elongate bearing rib to a front, in particular continuously.

19. A household refrigeration appliance, comprising:

a housing having an external housing and an internal container which is separate therefrom, said internal container configured according to claim 1, and being disposed in said external housing, and a receiving space for food being delimited thereby.

* * * * *